US007150708B2

(12) United States Patent
Lurz

(10) Patent No.: US 7,150,708 B2
(45) Date of Patent: Dec. 19, 2006

(54) LABORATORY CENTRIFUGE WITH SWING-OUT CONTAINERS AND AERODYNAMIC CLADDING

(75) Inventor: Werner Lurz, Kaltenkirchen (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 11/072,580

(22) Filed: Mar. 4, 2005

(65) Prior Publication Data

US 2005/0221972 A1 Oct. 6, 2005

(30) Foreign Application Priority Data

Mar. 10, 2004 (DE) ..... 10 2004 012 025

(51) Int. Cl.
*B04B 5/02* (2006.01)

(52) U.S. Cl. ..... 494/20

(58) Field of Classification Search ..... 494/16, 494/20, 21, 33; 422/72

See application file for complete search history.

(56) References Cited

U.S. PATENT DOCUMENTS

| | | | | |
|---|---|---|---|---|
| 3,028,075 | A * | 4/1962 | Blum | 494/20 |
| 4,093,118 | A * | 6/1978 | Sinn et al. | 494/20 |
| 4,344,563 | A * | 8/1982 | Romanauskas | 494/20 |
| 4,435,169 | A * | 3/1984 | Romanauskas | 494/20 |
| 4,449,966 | A * | 5/1984 | Piramoon | 494/20 |
| 4,670,004 | A * | 6/1987 | Sharples et al. | 494/20 |
| 4,886,486 | A * | 12/1989 | Grimm et al. | 494/20 |
| 5,545,118 | A * | 8/1996 | Romanauskas | 494/16 |
| 5,562,584 | A * | 10/1996 | Romanauskas | 494/20 |
| 6,746,391 | B1 * | 6/2004 | Lurz et al. | 494/20 |
| 2002/0173415 | A1 | 11/2002 | Mesa | |
| 2003/0199382 | A1 | 10/2003 | Moscone, Sr. | |
| 2005/0221972 | A1 * | 10/2005 | Lurz | 422/72 |

FOREIGN PATENT DOCUMENTS

| | | |
|---|---|---|
| CH | 254325 | 4/1948 |
| JP | 57-165051 | * 10/1982 |
| JP | 9-155235 | * 6/1997 |
| JP | 2003-230849 | * 8/2005 |

OTHER PUBLICATIONS

Products and Applications for the Laboratory 2003; Eppendorf, pp. 102-107.

* cited by examiner

*Primary Examiner*—Charles E. Cooley
(74) *Attorney, Agent, or Firm*—Rankin, Hill, Porter & Clark LLP

(57) ABSTRACT

The invention relates to a laboratory centrifuge rotor (1) running in air and devoid of an air chamber, comprising rotor arms (2) ending in fork arms (4), containers (6) swinging out on pivot pins (5) being suspended between said arms (2), said rotor being characterized in that an aerodynamic cladding component (12, 16, 20, 25) is mounted ahead as seen in the direction of motion on each rotor arm (2, 4) and/or ahead of each container (6) in at least the radially outermost regions of the zones (7) facing the incident airflow of the swung-out containers (6).

4 Claims, 4 Drawing Sheets

LABORATORY CENTRIFUGE WITH SWING-OUT CONTAINERS AND AERODYNAMIC CLADDING

BACKGROUND OF THE INVENTION

1. Field of the Invention

The present invention relates to the field of laboratory centrifuge rotors.

2. Description of Related Art

A standard laboratory centrifuge rotor design offers the advantage of swing-out containers where the direction of force remains constant at all angular speeds. The containers being movable outward, they can be removed from the rotor and be conveniently loaded/unloaded outside the centrifuge. The containers may assume different shapes in order to accept different kinds of sample containers. This feature ranges from large bottles to sample tubules to stacks of microtiter plates received in an open, boxy container.

To generate very high forces shortening centrifuging time, centrifuges of the above species run at very high angular speeds. In the process, the rotor together with the containers is then exposed to very high incident airflows.

In the standard design, the containers preponderantly are designed for being easily suspended between the fork arms, for good loading and also with a plane support surface for safe setup during loading/unloading. As a result the containers can hardly be aerodynamically optimal.

Strong turbulence at the rotor and at the containers arises at high incident airflows. Accordingly high air drag is generated at high angular speeds which in turn entail large rises in air temperature. The high drag must be counteracted by a powerful motor in turn itself dissipating considerable heat. As a result the air temperature rises much in the housing which for safety reasons encloses the entire centrifuge. This temperature rise would degrade the samples to be centrifuges and therefore must be compensated by a cooling unit. These requirements also substantially increase the costs of laboratory centrifuges. Moreover considerable noise is produced by the said air turbulence and can be damped only inadequately by the enclosing housing.

Air chambers such as disclosed in the German patent document 4027993 A1 are known to overcome the above problem. Such an air chamber is an aerodynamically smooth inner housing enclosing the rotor and rotating with it. Within the said air chamber, the air flows jointly with the motor which therefore does not experience turbulence. However such an air chamber incurs the drawback that it encloses the rotor and the containers, as a result of which thermostatting the samples at desired temperatures is much more difficult. The costs of such a design again are very high.

Again the US 2003/0199382 A1 patent document discloses a centrifuge equipped with an air chamber which however is quite shallow and receives the pivotably supported containers only in their swung-out state. The German patent document DE 38 03 255 C1 also shows an air chamber design wherein however the containers are not supported in a manner allowing to remove them and to load them through an aperture in the air chamber cover.

US 2002/0173415 A1 discloses a rotor of the above species of which the rotor arms comprise aerodynamically well shaped external surfaces which are configured peripherally but between which the swung-out containers project widely by their outward zones and thereby induce strong air perturbations.

The German patent document DE 24 47 136 A1 shows an ultracentrifuge, that is a centrifuge of exceedingly high angular speeds, of which the rotor basically moves in a vacuum, thereby eliminating aerodynamics from consideration.

The German patent document DE 101 55 955 C2 shows a rotor of the above species where the aerodynamic problem is resolved in a wholly different manner, namely using turbulence generators mounted on the containers for the purpose of controlling the generated turbulence entrainment.

Lastly, the German patent document DE 25 26 534 A1 shows aerodynamic cladding components for motor trucks.

SUMMARY OF THE INVENTION

The objective of the present invention is to create a rotor of the above species that shall generate little heat and little noise while being devoid of an air chamber, yet at high angular speeds and low motor power.

The present invention calls for an aerodynamic cladding component at each rotor arm and/or at each container, said cladding components aerodynamically improving the containers at least at their radially outermost zones. Energy effects from the incident airflow such as generated heat and noise increase as the $4^{th}$ power of the radial distance from the rotor axis. In the swung-out state, that is at high angular speeds, the containers project beyond the rotor arms and they constitute the radially outermost zones where the highest air speeds are encountered. Aerodynamic cladding is at its most critical in said outermost zones because of the interference increasing as the fourth power of the radius. In said zones, aerodynamic cladding shall very markedly reduce air turbulence. Air drag is considerably reduced and therefore substantially less motor power suffices. Again the air-turbulence generated heat is also much reduced, as is the noise. An air chamber no longer is required, hence the samples in the containers can be thermostatted as desired by heating and cooling elements in the centrifuge housing. The containers therefore may retain their shapes, which otherwise would be aerodynamically undesirable, whereby their applicability is now unrestricted. The cladding components may be in the form of simple and economical add-on elements which illustratively may also be used to retrofit known rotors of the above species.

The cladding components are affixed to the rotor arms, for instance to the fork arms in the immediate vicinity of the containers. Such cladding may be reliably affixed at said sites to absorb the applied high aerodynamic and centrifugal forces.

The cladding components can be rigidly affixed to the rotor arms and must be lined up in a way to cover the containers when in their swung-out state. Also, the cladding components also may be supported in pivotable manner so they may swing out together with the containers. In this manner appropriate aerodynamic container cladding is already implemented at low angular speeds. Foremost the design of swing-out cladding components that, when the centrifuge is standing still, are suspended together with the containers, offers easier access from above to the containers which thereby may be removed conveniently and without being hampered by the cladding components.

The cladding components also may be mounted directly on the containers. In that event however the cladding components must be detachable to allow removing the containers between the fork arms.

The cladding components may be lightweight, solid bodies illustratively made of foam, however advantageously, they may be in the form of shells. As a result they may be made very rigid and lightweight in order to reduce the centrifugal forces that increase with cladding component weight.

The largest effect is attained by an aerodynamic cladding component being in front of the containers as seen in the direction of motion. However additionally cladding to the rear of the container—namely complete cladding—may advantageously further reduce air turbulence.

In an advantageous alternative to single cladding components in front and behind the containers, the peripheral segments between the containers thereby are closed off by arcuate cladding components as a result of which an optimal aerodynamics which is smoothly and annularly closed has been attained except for minor gaps at the rotor periphery.

Further advantageous features result in completely cladding, with optimal aerodynamic improvement, the critical, radially outermost zones of the containers.

Further advantageous features offer a simple structure which is affixable to the container and which simultaneously constitutes the cover element anyway required for container sealing.

BRIEF DESCRIPTION OF THE DRAWINGS

The present invention is illustratively and schematically elucidated in relation to the appended drawings.

DETAILED DESCRIPTION OF THE PREFERRED EMBODIMENT

Figure 1:
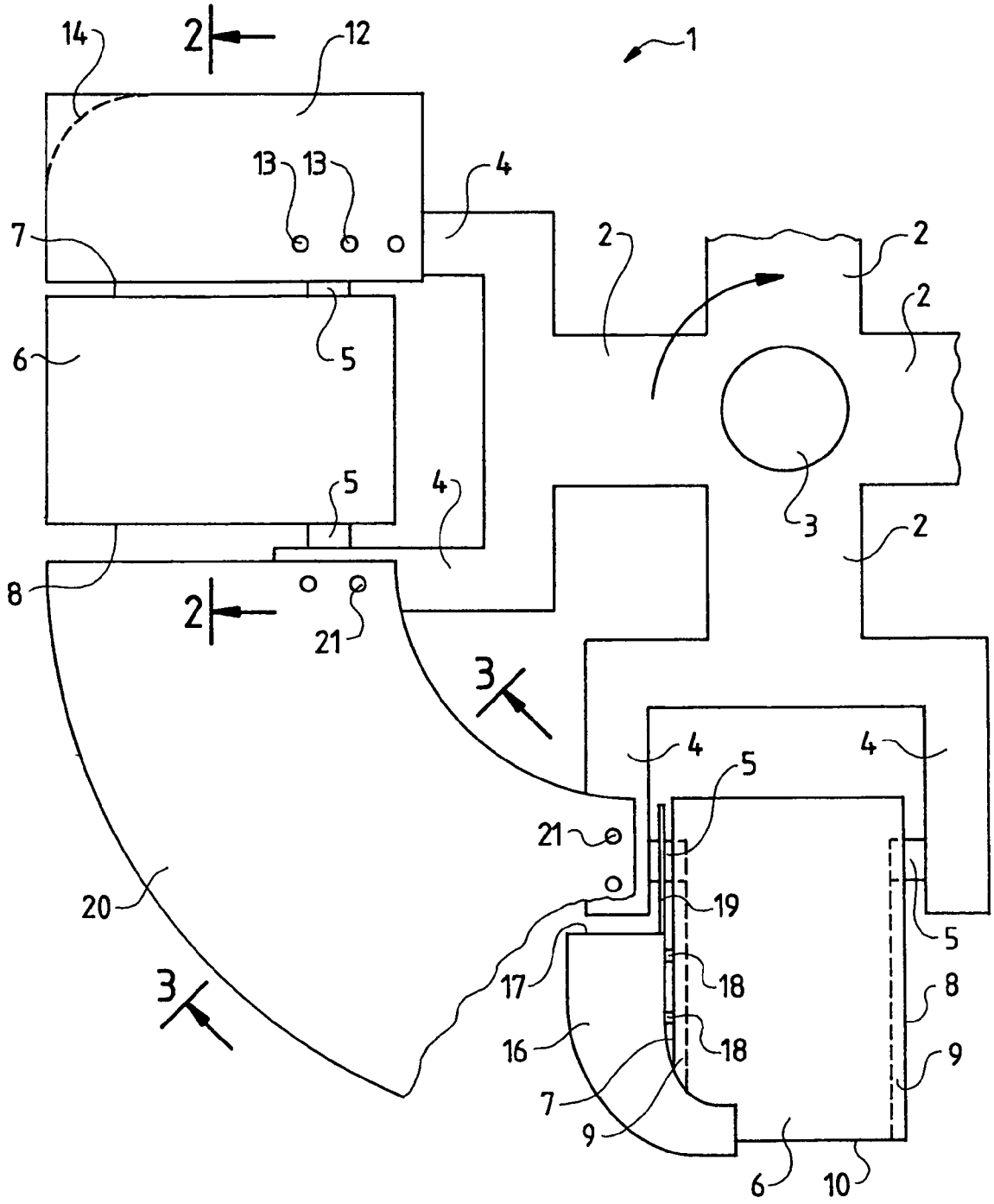
FIG. 1 is a top view of a rotor holding containers and includes three different embodiment modes of the cladding component.

FIG. 1 is a top view of a laboratory centrifuge rotor 1. In this embodiment mode, said rotor comprises four rotor arms 2 and rests on a vertical shaft 3 driven by an omitted motor in the direction of rotation indicated by the arrow. The overall assembly is enclosed by a safety housing which comprises an upper cover element allowing access from above to the rotor as shown in FIG. 1. More information may be found about this design in the initially cited brochure pages.

The rotor arms 2 change radially outward into fork arms 4 fitted with inwardly projecting pivot pins 5 from which containers 6 can be suspended between the fork arms 4.

Figure 2:
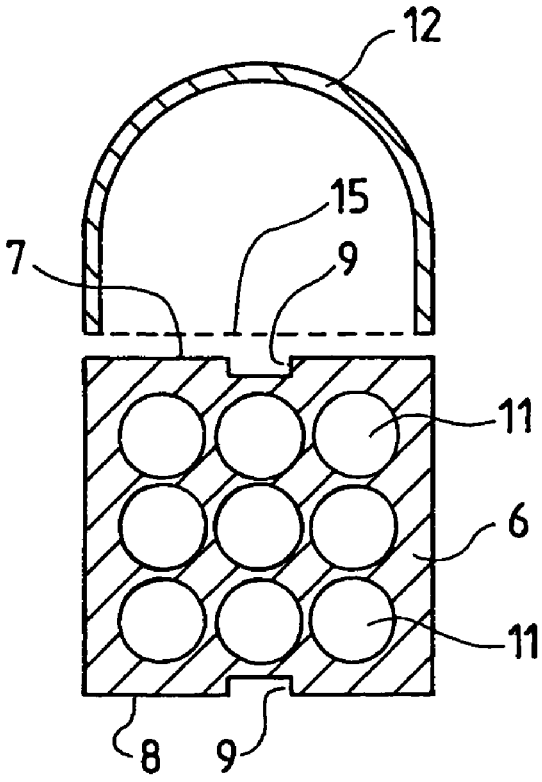
FIG. 2 is a section of FIG. 1 along line 2—2.

As shown by FIG. 2, the containers 6 of this embodiment mode exhibit a substantially square cross-section and each is fitted as seen in the direction of motion at its front end face and at its rear end face 8 with a longitudinal groove 9 that is open relative to the plane bottom surface 10 of the container 6 and closed in rounded manner at its upper end underneath the upper end of the container 6. When the rotor 1 is standing still, the containers 6 are suspended by the upper closed end of the grooves 9 from the pivot pins 5 and may be lifted upward and out between the fork arms 4, the pivot pins 5 in this process moving as far as the lower end through the grooves 9. Reversely the containers may be hung up again and then are suspended from the pivot pins 5 in swinging manner and with their centers of gravity below said pins.

FIG. 1 shows the swung-out state of the containers 6 at higher angular speeds. In this state, the containers 6 are horizontal. The fully swung-out state is reached already at relatively low angular speeds.

As shown by FIGS. 1 and 2, the containers 6 exhibit an extremely disadvantageous aerodynamic shape. At the direction of flow indicated clockwise by an arrow in FIG. 1, said containers by their front end face 7 are perpendicular to the incident airflow and accordingly subtend a very high drag coefficient. The sharp corners and the groove 9 entail strong air turbulence. On the other hand the shown square cross-section of this diagrammatic embodiment mode is highly advantageous to subtend many boreholes 11 receiving sample containers.

In another embodiment mode of the invention, the containers 6 also may be designed to have one large inside space to receive a single bottle or to be widely open so as to comprise substantially only wall zones in the regions of the base surface 10 and the end faces 7 and 8 to receive a stack of microtiter plates.

Cladding components described below in the form of several embodiment modes are used in the invention to improve the aerodynamics of the shown rotor 1.

Figure 4:
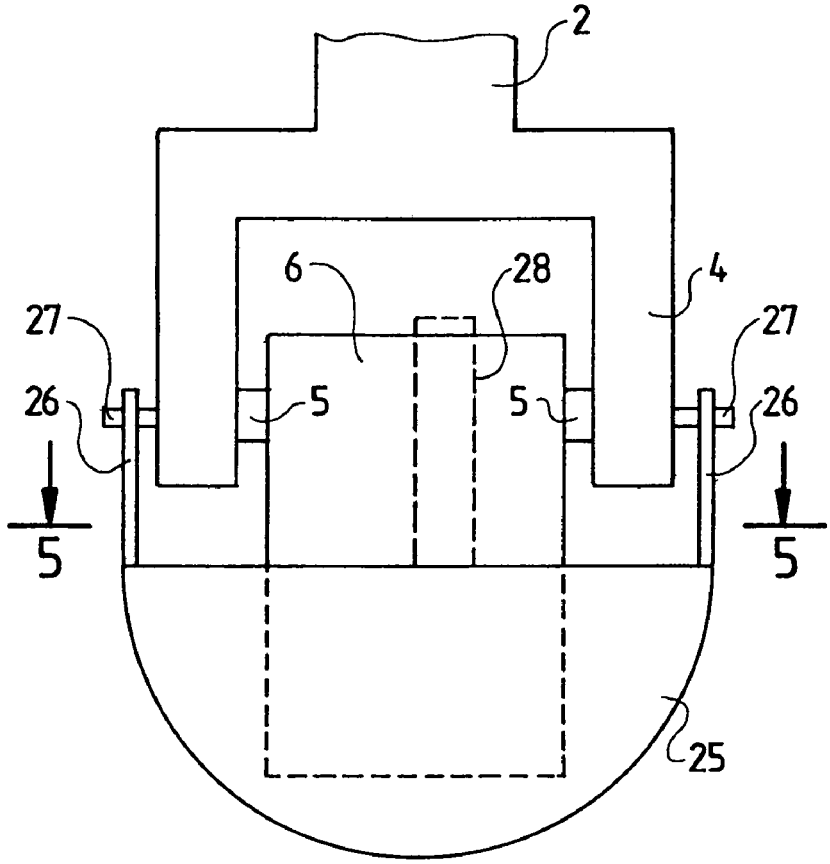
FIG. 4 is a cutaway of FIG. 1 showing a container clad in alternative manner.

FIGS. 1 and 2 show a cladding 12 which, as indicated in FIG. 2 in solid lines, assumes the shape of an arcuate externally half-cylindrical shell. Illustratively said shell is securely affixed by fasteners 13 to a fork arm 4 and, as shown in FIG. 4, it covers the front end face 7 of the container 6 facing into the incident air flow. As shown by FIG. 2, this design offers an extremely aerodynamically advantageous container cover element in the direction of motion, attaining a very marked reduction in air turbulence at this container.

As shown by dashed lines in FIGS. 1 and 2, the radially outermost zone of the cladding component 12 may be rounded at 14 and run as a closed, dome-like surface as far as the edge 15 (FIG. 2). As a result aerodynamic matching to the container 6 is further improved in the region of the cladding component 12.

It must be borne in mind that the incident airflow effects at a given rotor angular speed rise as the $4^{th}$ power of the distance from the axis of the shaft 3. Accordingly aerodynamic designs are most critical in the radially outermost zones of the container 6 near its bottom surface 10.

The above described cladding 12 may be fitted in the above shown manner to all four rotor arms 2.

An alternative embodiment mode also shown in FIG. 1 comprises a cladding component 16 which substantially corresponds in its radially inner terminal zone to the shape of the cladding 12 shown in FIG. 2. The cladding component 16 also is rounded in the outer terminal zone near the base 10 of the container 6 as shown for the cladding component 12 at 14. However, as shown in FIG. 1, said cladding component 16 runs around the lower corners of the container 4 and continues over the base 10, thereby offering still further improved aerodynamic cladding.

The cladding component 16 projects farther outside by its radially inner ends 17 than the radially inner end of the cladding component 12. Substantially the cladding component 16 is configured only where a maximum aerodynamic effect is required, namely at the radially outermost zone of the container 6.

Unlike the cladding component 12 affixed to the fork arm 4, the cladding component 16 is affixed by brace elements 18 to the container 6 on the front end face 7. The affixation by the brace elements 18 is detachable. Illustratively the brace elements 18 may be plugged into holes on the end face 7 of the container 6. The cladding component 16 must be detachable because it is suspended underneath the fork arm 4 when the rotor 1 is standing still, that is when the container 6 hangs down, and therefore would hamper removing this container in the upward direction.

FIG. 1 indicates a further way to affix said cladding component 16. Instead of being affixed to the container 6, the cladding component 16 might be pivotably affixed by an arm 19 about the pivot pin 5. In such a case said cladding component would pivot jointly with the container 6 without interfering with it when being pulled up and out. Moreover the cladding 12 might also be correspondingly pivotably affixed to the fork arm 4.

Figure 3:
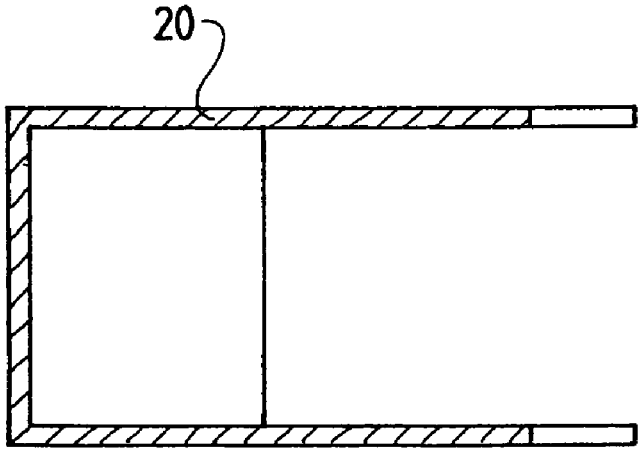
FIG. 3 is a section of FIG. 1 along line 3—3.

FIG. 1 furthermore shows a third embodiment mode of a cladding component in the form of an arcuate cladding component 20 which, as shown in FIG. 3, also is a shell that is closed at the top, at the bottom and radially outward. The arcuate cladding component 20 is affixed by fasteners 21 both to the forward fork arm 4 of a rotor arm 2 and to the subsequent fork arm 4 of the next rotor arm 2 and aerodynamically clads the arcuate segment between a container 6 and the nearest, following container 6. Except for a gap, aerodynamically perfect and full cladding is attained by four arcuate cladding components 20 fitted to a rotor and by the containers 6 configured between the arcuate segments.

As shown by FIG. 2, a cladding component 12 is configured as seen in the direction of motion ahead of the front end face 7 of the container 6 facing into the direction of airflow. An illustratively identically designed cladding component may be mounted symmetrically to such a configuration also ahead of the rear end face 8 in order to impart its own full aerodynamic cladding to each container 6.

Figure 5:
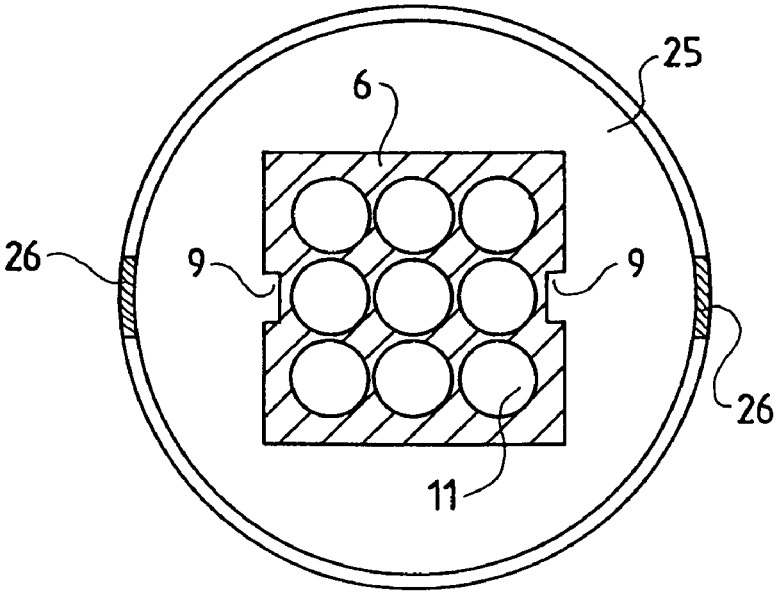
FIG. 5 is a section of FIG. 4 along line 5—5.

FIGS. 4 and 5 render an illustrative embodiment variation where the container 6 shown in the swing-out position is enclosed at its radially outermost zones, namely beyond the ends of the fork arms 4, by tub-shaped cladding components 25. The tub 25 rests by arms 26 on a spindle 27 aligned with the pins 5 though said tub also may rest directly on the pins 5 similarly to the case for the cladding component 16. In this manner the tub 25 jointly with the container 6 shall be able to swing outward.

In an alternative embodiment mode indicated by dashed lines in FIG. 4, the tub 25 may be affixed to the container 6 by arms 28 which illustratively act like hooks gripping the upper rim of the cover 6, though said tub must be detached from the said container before said container is removed from the centrifuge.

As shown in FIGS. 4 and 5, the tub 25 may be made extremely aerodynamically advantageous and it may clad the critical, radially outermost zones of the container 6 at high aerodynamic efficacy.

The cladding components 12, 16, 20 and 25 are shown as shells in the Figures. They must withstand very high forces without being warped. Accordingly mechanically strong materials such as metals or very durable plastics, for instance fiber-reinforced plastics, are advantageously used in their manufacture. Optionally the shells may be reinforced using stiffening ribs advantageously situated on their insides. Also hard foaming may be used for reinforcement.

Figure 6:
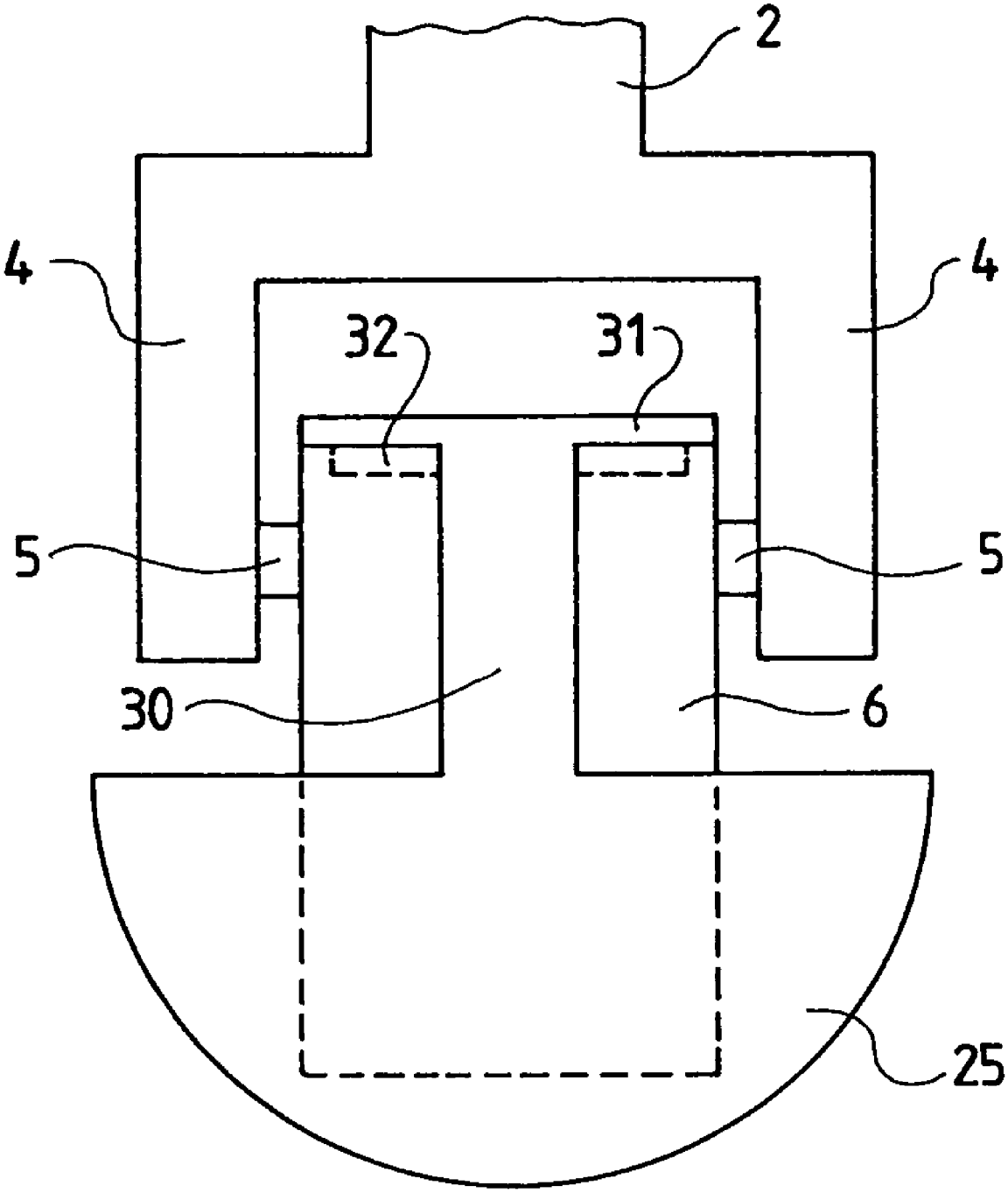
FIG. 6 is a view according to FIG. 4 of that embodiment including a cover element.

FIG. 6 shows a further embodiment mode similar to those of FIGS. 4 and 5. As already mentioned in relation to FIG. 4, the tub 25 having arms 28 shown in dashed lines may be affixed to the upper edge of the container 6. FIG. 6 shows a similar design.

The tub 25 may substantially correspond to that of FIGS. 4 and 5. This tub is connected by means of a strip 30 on the side of the container 6 shown in FIG. 6 to a cover element 31 which is inserted from above on the aperture of the container 6 where it is secured in place, for instance by the inner component 32 shown in dashed lines, into the container. The strip 30 must exhibit both high tensile strength and be able to bend resiliently to allow removing the cover element 31.

Preferably the container 6 is received in geometrically locking manner by its lower part shown in dashed lines into a matching recess in the tub 25 made of a solid material.

Before the container 6 can be lifted out of the fork arms 4, first the cover element 31 must be lifted from the container while the strip 30 is being bent and then said cover element must be flipped to the side. Thereupon the tub 25 may be pulled out downward out of the container 6. Reinstallation at a container prior to centrifuging takes place in the reverse order.

In this manner the tub 25 is reliably secured to the container 6 while simultaneously a cover element 31 is subtended which is anyway required at the container 6 to protect in well-sealed manner the sample to be centrifuged contained in it against air turbulence that might entrain some samples into other samples and soil the centrifuge.

The invention claimed is:

1. A laboratory centrifuge rotor running in non-rotating air, comprising:

rotor arms ending in fork arms;

a plurality of containers being suspended between said fork arms for swing out motion so as to pivotally move between an at rest position and a swung out position; and an aerodynamic cladding component that is mounted in front of each container, as seen in a direction of motion, said cladding component at least covering a radially outermost part of the associated container in the swung out position and wherein, as the lab centrifuge rotor runs, said cladding component faces into an incident air flow of the non-rotating air and aerodynamically passes therethrough, the cladding components are affixed by fasteners to the rotor arms, and wherein the fasteners are able to move to a swung out position.

2. A laboratory centrifuge rotor running in non-rotating air, comprising:

rotor arms ending in fork arms;

a plurality of containers being suspended between said fork arms for swing out motion so as to pivotally move between an at rest position and a swung out position; and an aerodynamic cladding component that is mounted in front of each container, as seen in a direction of motion, said cladding component at least covering a radially outermost part of the associated container in the swung out position and wherein, as the lab centrifuge rotor runs, said cladding component faces into an incident air flow of the non-rotating air and aerodynamically passes therethrough, and wherein the cladding components are detachably affixed to parts of the containers that in the swung-out position are outside the fork arms.

3. The rotor as claimed in claim 2, wherein the cladding components are each secured by a tensile connection to a cover element detachably sealing off the container.

4. A laboratory centrifuge rotor running in non-rotating air, comprising:

rotor arms ending in fork arms;

a plurality of containers being suspended between said fork arms for swing out motion so as to pivotally move between an at rest position and a swung out position; and an aerodynamic cladding component that is mounted in front of each container, as seen in a direction of motion, said cladding component at least covering a radially outermost part of the associated container in the swung out position and wherein, as the lab centrifuge rotor runs, said cladding component faces into an incident air flow of the non-rotating air and aerodynamically passes therethrough, and wherein the cladding components are designed as tubs enclosing the radially outermost part of the containers in the swung-out position and that said tubs are detachably affixed to or pivotably supported on the rotor arm to allow said tubs to swing out.

* * * * *